US011077482B2

(12) United States Patent
Obermaier et al.

(10) Patent No.: US 11,077,482 B2
(45) Date of Patent: Aug. 3, 2021

(54) RADIAL/AXIAL RING ROLLING MILL FOR ROLLING A RING

(71) Applicant: Schuler Pressen GmbH, Göppingen (DE)

(72) Inventors: Georg Obermaier, Rettigheim (DE); Jochen Schweikert, Waghäusel (DE)

(73) Assignee: Schuler Pressen GmbH, Göppingen (DE)

( * ) Notice: Subject to any disclaimer, the term of this patent is extended or adjusted under 35 U.S.C. 154(b) by 19 days.

(21) Appl. No.: 16/644,742

(22) PCT Filed: Aug. 22, 2018

(86) PCT No.: PCT/EP2018/000409

§ 371 (c)(1),
(2) Date: Mar. 5, 2020

(87) PCT Pub. No.: WO2019/048076

PCT Pub. Date: Mar. 14, 2019

(65) Prior Publication Data

US 2020/0261962 A1 Aug. 20, 2020

(30) Foreign Application Priority Data

Sep. 8, 2017 (DE) ..... 10 2017 008 449.1

(51) Int. Cl.
*B21H 1/06* (2006.01)
*B21B 13/08* (2006.01)
(Continued)

(52) U.S. Cl.
CPC ..... *B21H 1/06* (2013.01); *B21B 13/08* (2013.01); *B21B 31/02* (2013.01); *B21H 1/12* (2013.01)

(58) Field of Classification Search
CPC ..... B21H 1/06; B21H 1/12; Y10T 29/49689; B21B 13/08; B21B 31/02;
(Continued)

(56) References Cited

U.S. PATENT DOCUMENTS 2,280,783 A * 4/1942 Bell ..... B21H 1/06 72/87
2,307,191 A * 1/1943 Bell ..... B21H 1/06 72/87

(Continued)

FOREIGN PATENT DOCUMENTS

DE 3824856 A1 1/1990
DE 202010014708 U1 1/2011

(Continued)

OTHER PUBLICATIONS

International Search Report with English translation corresponding to International Application No. PCT/EP2018/000409, dated Dec. 14, 2018 (8 pages).

(Continued)

*Primary Examiner* — Matthew P Travers
(74) *Attorney, Agent, or Firm* — Flynn Thiel, P.C.

(57) ABSTRACT

A radial/axial ring rolling mill for rolling a ring has an axial rolling device and a radial rolling device. The radial rolling device includes a main roller and a roller mandrel, between which the ring can be shaped. The roller mandrel is retained in the upper region thereof on a mandrel bearing head supported in a first linear adjustment device to be able to be horizontally adjusted in such that the roller mandrel can be moved perpendicularly to the longitudinal extent thereof in the direction towards the main roller and in the opposite direction thereto. The first linear adjustment device together with the mandrel bearing head and the roller mandrel is able to be adjusted as a unit by a second linear adjustment device
(Continued)

Figure 1:
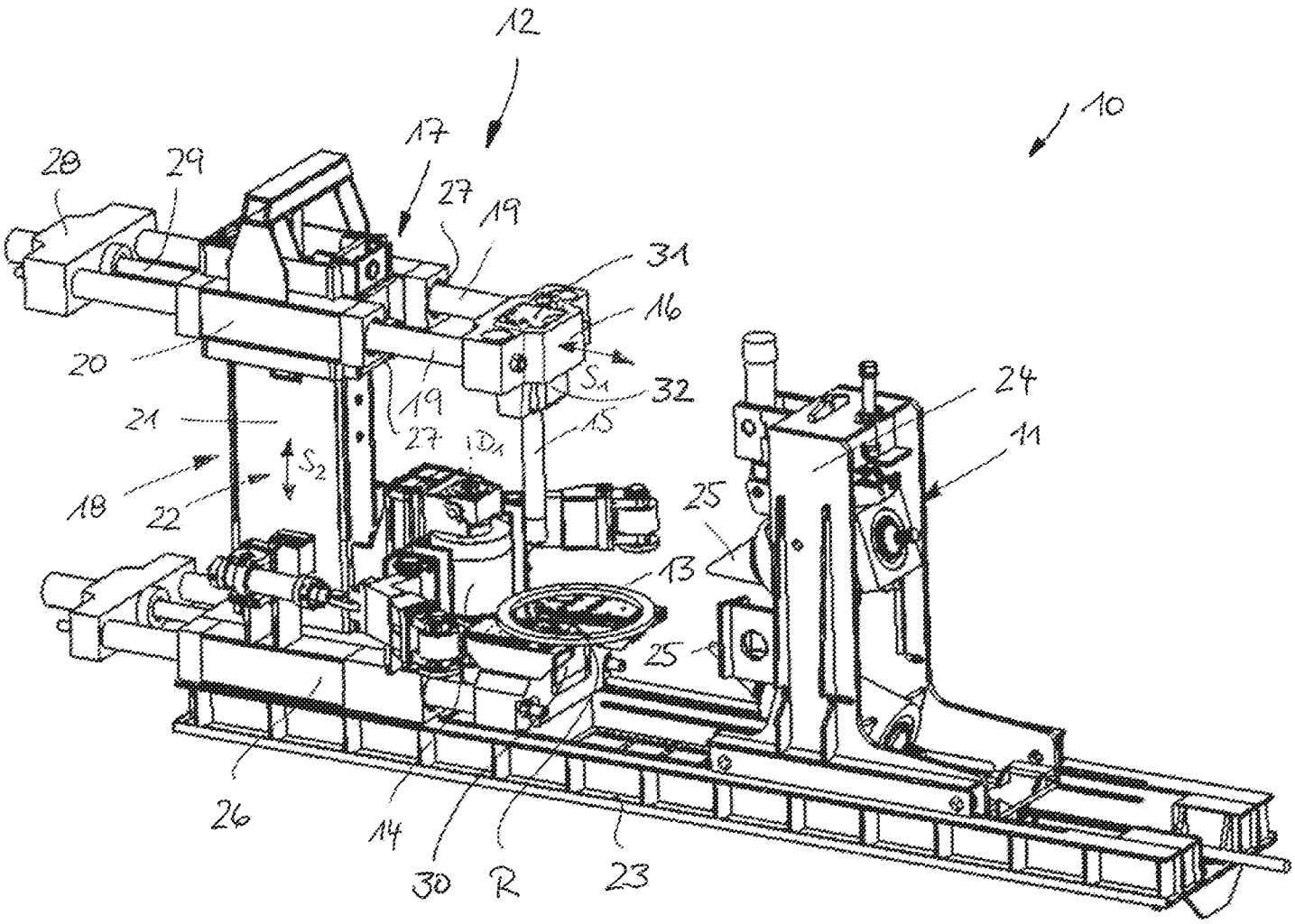

in a vertical manner so that the roller mandrel can be pulled out of the inner space of the ring and introduced therein.

19 Claims, 2 Drawing Sheets

(51) Int. Cl.
*B21B 31/02* (2006.01)
*B21H 1/12* (2006.01)

(58) Field of Classification Search
CPC ..... B21B 2031/025; B21B 2031/026; B21B 31/18; B21B 31/20; B21B 31/32
See application file for complete search history.

(56) References Cited

U.S. PATENT DOCUMENTS

| | | | | | |
|---|---|---|---|---|---|
| 3,186,202 | A * | 6/1965 | Ulrych | B21H 1/06 | 72/9.5 |
| 3,698,218 | A * | 10/1972 | Wieting | B21H 1/06 | 72/11.2 |
| 3,709,011 | A * | 1/1973 | Wieting | B21H 1/06 | 72/9.5 |
| 3,859,830 | A * | 1/1975 | Jeuken | B21H 1/06 | 72/8.3 |
| 4,339,937 | A * | 7/1982 | Strugala | B21H 1/06 | 72/105 |
| 4,869,088 | A * | 9/1989 | Kadotani | B21H 1/06 | 72/11.1 |
| 8,365,564 | B2 * | 2/2013 | Hirose | B21H 1/06 | 72/110 |
| 10,507,502 | B2 | 12/2019 | Bolik | | |
| 2011/0138871 | A1 | 6/2011 | Vinzant et al. | | |
| 2015/0290700 | A1 * | 10/2015 | Bolik | B21C 51/00 | 72/12.8 |
| 2017/0225222 | A1 | 8/2017 | Rodermund-Gebhart et al. | | |
| 2019/0232348 | A1 * | 8/2019 | Bierhalter | B21H 1/06 | |

FOREIGN PATENT DOCUMENTS

| | | | |
|---|---|---|---|
| DE | 102016101939 | A1 | 8/2017 |
| EP | 2274118 | B1 | 1/2011 |
| EP | 2937158 | A1 | 10/2015 |
| WO | 2009125102 | A1 | 10/2009 |
| WO | 2009147359 | A1 | 12/2009 |
| WO | 2016020869 | A1 | 2/2016 |

OTHER PUBLICATIONS

Written Opinion of International Searching Authority corresponding to International Application No. PCT/EP2018/000409, dated Dec. 14, 2018 (5 pages).

German Search Report corresponding to German Application No. 10 2017 008 449.1, dated May 22, 2018 (6 pages).

* cited by examiner

RADIAL/AXIAL RING ROLLING MILL FOR ROLLING A RING

The invention relates to a radial/axial ring rolling mill for rolling a ring, having an axial rolling device and a radial rolling device, wherein the radial rolling device has a main roller and a roller mandrel, between which the ring can be shaped, wherein the roller mandrel is retained in the upper region thereof on a mandrel bearing head which is supported in a first linear adjustment device so as to be able to be horizontally adjusted in such a manner that the roller mandrel can be moved perpendicularly to the longitudinal extent thereof in the direction towards the main roller and in the opposite direction thereto.

A radial/axial ring rolling mill of the type mentioned is set out in DE 10 2016 101 939 A1 and is used to roll seamless rings from a metal blank or a ring preform. The ring preform is shaped by means of different rollers from the original diameter to the desired end diameter. The axial rolling device serves in this instance to shape the ring in the direction of the rotation axis thereof or an axis which is parallel therewith, that is to say, to shape the side flanks of the ring. The radial rolling device serves to shape the ring in a direction which extends perpendicularly thereto, that is to say, in the direction of the radius of the ring which is intended to be formed. The terms "axial" and "radial" are used accordingly in the context of this description.

In the known radial/axial ring rolling mill, the ring preform is placed on a substantially horizontal table and a roller mandrel is, for example, introduced from above into the inner space of the ring. The roller mandrel is supported so as to be able to be vertically displaced on a mandrel bearing head arranged above the table and can be lowered until the lower end of the roller mandrel engages in a lower mandrel bearing which is arranged below the table.

In order to be able to remove the rolled ring at the end of the rolling operation, the roller mandrel must be pulled out of the rolled ring, which can be carried out by it being pulled vertically upwards relative to the mandrel bearing head by means of a mandrel lifting device. In this instance, there is the problem that the mandrel lifting device in the upper position thereof protrudes to a relatively significant extent upwards above the mandrel bearing head, whereby there is the risk of the mandrel lifting device becoming damaged or bent, for example, as a result of a crane, by means of which a ring preform is placed in the ring rolling mill or the completed ring is removed from the ring rolling mill.

The shaping of the ring preform in a radial direction takes place between a main roller and the roller mandrel. To this end, it is necessary to adjust the spacing between these two components. This is carried out with the known radial/axial ring rolling mill by the mandrel bearing head which carries the mandrel lifting device being guided in an adjustable manner in a horizontal linear adjustment device relative to the machine frame. By adjusting the mandrel bearing head by means of the horizontal linear adjustment device, the roller mandrel can be moved in a radial direction towards the main roller and in an opposite direction thereto.

A radial/axial ring rolling mill is used not only for a specific size of a ring which is intended to be rolled, but also for different ring sizes. In this instance, rings which may differ significantly in terms of their axial height are rolled. Particularly with relatively small rings with a small inner diameter and thereby a corresponding small roller mandrel diameter and with a small axial ring height, there is a relatively high bending loading of the roller mandrel when the spacing between the lower mandrel bearing and the upper mandrel bearing is too large. It is known to lower the upper mandrel bearing relative to the mandrel bearing head by means of the mandrel lifting device, whereby the bending length of the roller mandrel is reduced and the bending loading during the shaping process is accordingly reduced. However, it is disadvantageous in this case that there is adjusted between the upper mandrel bearing and the mandrel bearing head a vertical offset, which leads to bending torques which have to be absorbed in the mandrel bearing head.

An object of the invention is to provide a radial/axial ring rolling mill for rolling a ring in which in a structurally simple manner an adaptation of the geometric relationships to the size of the ring which is intended to be rolled is possible.

This object is achieved according to the invention with a radial/axial ring rolling mill having the features of claim 1. In this case, there is provision for the first linear adjustment device together with the mandrel bearing head and the roller mandrel to be able to be adjusted as a unit by means of a second linear adjustment device in a vertical manner so that the roller mandrel can be pulled out of the inner space of the ring and introduced therein.

According to the invention, there is taken as a basis the basic consideration that it is possible to dispense with the mandrel lifting device which is formed on the mandrel bearing head in the prior art and that the roller mandrel can be securely fitted to the mandrel bearing head. For vertical adjustment of the roller mandrel, it is no longer adjusted relative to the mandrel bearing head, but instead the roller mandrel is adjusted together with the mandrel bearing head and together with the horizontal first linear adjustment device of the mandrel bearing head as a unit. In this manner, an offset is reliably prevented from being able to be formed between the mandrel bearing head and the upper mandrel bearing.

Since according to the invention there is no relative adjustment between the roller mandrel and the mandrel bearing head, the problem is also prevented of the mandrel lifting device protruding upwards far beyond the mandrel bearing head.

The first linear adjustment device for the horizontal adjustment of the mandrel bearing head and consequently for the radial adjustment of the roller mandrel extends horizontally or at least with a significant horizontal component. In a preferred embodiment of the invention, there is provision for the mandrel bearing head to be preferably securely fitted to at least one and in particular two parallel horizontal carriers. The carriers may engage in a displaceable manner through a guiding carriage of the first linear adjustment device and be horizontally guided thereon, wherein at the side of the guiding carriage facing away from the mandrel bearing head a drive device for the adjustment movement, for example, a hydraulic cylinder, is preferably arranged.

The roller mandrel is preferably retained in a fixed and non-displaceable manner in the mandrel bearing head. If the roller mandrel has to be replaced, for example, as a result of wear, the connection between the mandrel bearing head and the roller mandrel has to be released. In this instance, there may be provision for the roller mandrel to be retained in the mandrel bearing head by means of clamping and in particular by means of hydraulic clamping.

The vertical adjustment of the unit which the first linear adjustment device and the mandrel bearing head and the roller mandrel comprises is preferably carried out by the guiding carriage of the first linear adjustment device being able to be adjusted along a vertically extending path of the second linear adjustment device. The path may, for example, be formed by a vertical guiding column which may be secured to the machine frame. The adjustment movement is preferably carried out by means of at least one hydraulic piston/cylinder unit.

In order to fix the first linear adjustment device and consequently also the mandrel bearing head and the roller mandrel in a predetermined position, the guiding carriage of the first linear adjustment device may be preferably fixed or secured to the path of the second linear adjustment device in a stepless manner. In particular, the fixing is carried out by means of clamping, which can be carried out hydraulically and/or pneumatically.

The upper end of the roller mandrel is secured in the mandrel bearing head by means of a mandrel bearing element. In order to change the roller mandrel, the mandrel bearing element can be removed in an upward direction from the mandrel bearing head. A new roller mandrel can subsequently be introduced again together with a new mandrel bearing element from above into the mandrel bearing head and subsequently fixed to the mandrel bearing head. Alternatively, it is also possible to separate the mandrel bearing element from the old roller mandrel and to attach it to a new roller mandrel and to then insert the mandrel bearing element together with the new roller mandrel into the mandrel bearing head.

In so-called non-productive times of operation of the radial/axial ring rolling mill, for example, during a workpiece change, the roller mandrel can be rotatably driven about the longitudinal axis thereof by means of a motor which is fitted, for example, to the mandrel bearing head and in particular to the mandrel bearing element. As a result of the rotation of the roller mandrel, the cooling thereof can be improved. During the operation of the radial/axial ring rolling mill, that is to say, during the rolling of a ring, this motor can be switched off or switched into a passive state.

There is preferably provision for the guiding carriage to be able to be displaced vertically upwards to such an extent that the roller mandrel is moved completely out of the ring. In this manner, the replacement of the ring or the insertion of a new ring preform is facilitated.

There is further provision for the guiding carriage to be able to be displaced so far downwards that the effective roller mandrel length, that is to say, the spacing between the lower mandrel bearing and the upper mandrel bearing head can be adapted to the height of the ring which is intended to be rolled and in particular can be shortened for rolling lower rings.

In a preferred embodiment of the invention, there is provision for the roller mandrel to be retained at the upper end thereof on the mandrel bearing element which can be releasably fixed in the mandrel bearing head. In this instance, the removable mandrel bearing element can be fixed in the mandrel bearing head, preferably by means of clamping.

The motor, by means of which the roller mandrel is rotatably driven, drives the roller mandrel preferably independently of the rolling torque of the ring which is intended to be rolled. In this instance, the motor is configured in such a manner that it can also drive the roller mandrel during the non-productive times of the operation of the radial/axial ring rolling mill, for example, during a workpiece change, in order, for example, to be able to better cool the roller mandrel during these times. During the normal rolling process, the motor is preferably switched into a passive state.

The mandrel bearing element which is fitted to the upper end of the roller mandrel is preferably retained in the mandrel bearing head in such a manner that tilting and/or rolling torques which occur can be introduced into the mandrel bearing head.

In order to roll a ring preform which is placed on a table with a horizontal orientation, the vertical second linear adjustment device is activated from an upper position, whereby the guiding carriage is moved together with the mandrel bearing head and the roller mandrel along the path of the column in a downward direction and lowered until the roller mandrel engages through the ring preform with the lower end thereof and engages in the lower mandrel bearing. At the same time or subsequently, the first linear adjustment device 17 is activated, whereby the mandrel bearing head is displaced with the roller mandrel relative to the guiding carriage in the direction of the main roller until the ring preform R is retained between these two components with a tight fit. Subsequently, the shaping operation is carried out in conventional manner.

Figure 2:
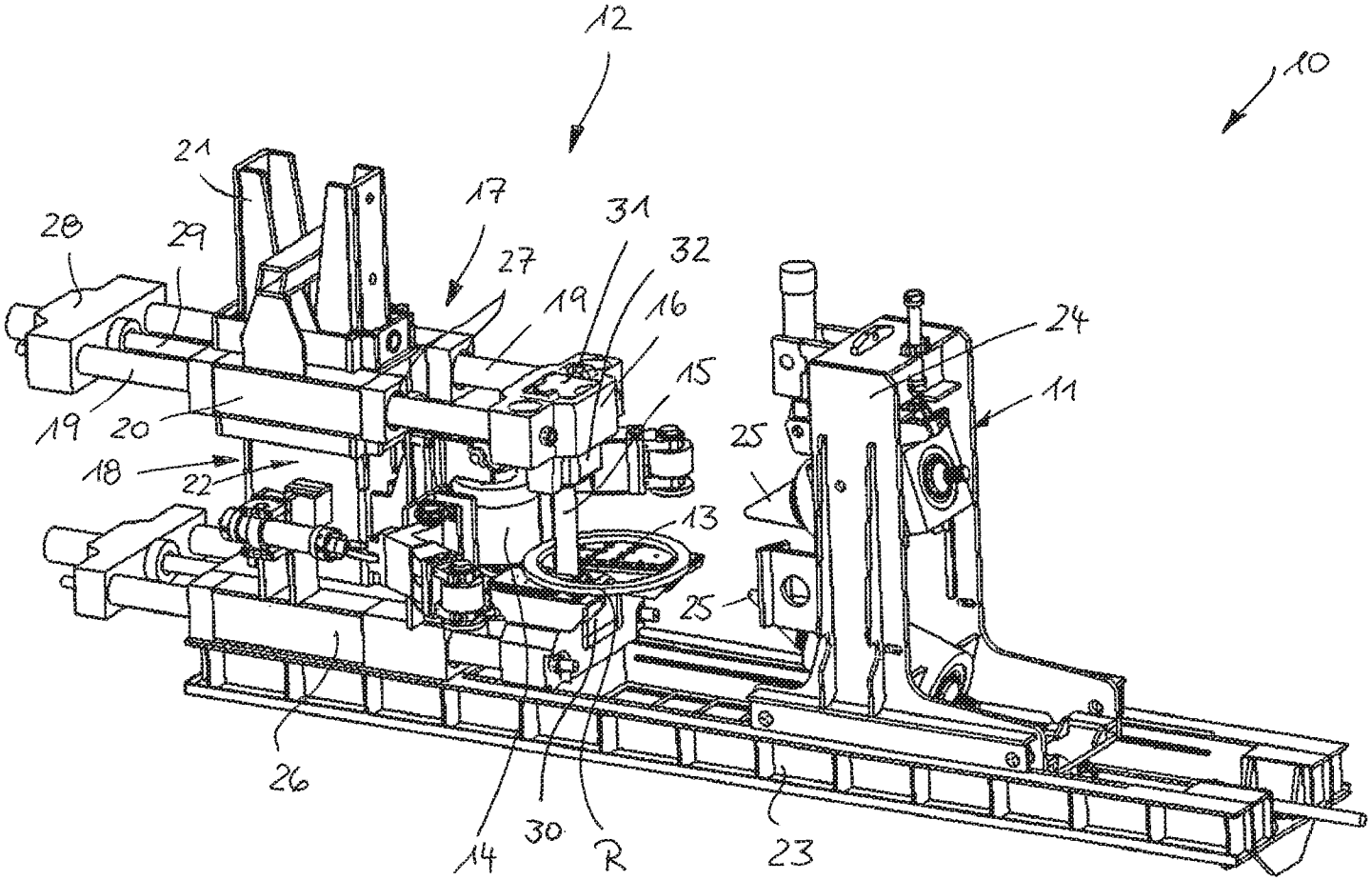

Further details and features of the invention can be seen from the following description of an embodiment with reference to the drawings, in which:

FIG. 1 is a perspective view of a radial/axial ring rolling mill, wherein the roller mandrel is arranged in a position pulled upwards out of the ring preform, and FIG. 2 shows the radial/axial ring rolling mill according to FIG. 1, wherein the roller mandrel is lowered and engages through the ring preform.

FIGS. 1 and 2 are perspective side views of a radial/axial ring rolling mill 10. The radial/axial ring rolling mill 10 has a base frame 23 on which an axial rolling device 11 is preferably displaceably mounted. The axial rolling device 11 has a frame 24, on which two tapered rollers 25 are supported in conventional manner.

With spacing from the axial rolling device 11, there is arranged on the base frame 23 a radial rolling device 12 which has a frame 26 which is securely positioned on the base frame 23. The radial rolling device 12 has in conventional manner a main roller 14 which is rotatably supported about a vertical rotation axis D1. In addition to the main roller 14, there is provided a horizontal table 13 on which an annular blank or a ring preform R can be placed, as illustrated in the Figures.

There is arranged on the frame 26 of the radial rolling device 12 a vertical column 21 which forms a vertical linear path 22 for a second linear adjustment device 18, by means of which a guiding carriage 20 can be vertically adjusted along the path 22 of the column 21, as indicated by the double-headed arrow S2.

The guiding carriage 20 can be fixed to the column 21 by means of clamping either in fixed positions or in a stepless manner in any desired position along the path 22.

The guiding carriage 20 is part of a first linear adjustment device 17 and has two parallel-extending guiding holes 27 which extend horizontally and through which a rod-like carrier 19 extends in each case, wherein the carriers 19 are displaceably supported in the guiding holes 27.

At the right end thereof facing the axial rolling device 11 according to FIG. 1 there is mounted on the carriers 19 a common mandrel bearing head 16 which connects the carriers 19 to each other.

At the side of the guiding carriage 20 facing away from the mandrel bearing head 16, the two carriers 19 are connected by means of a yoke 28, wherein between the yoke 28 and the guiding carriage there is arranged a hydraulic adjustment device 29 by means of which the carriers 19 and consequently also the mandrel bearing head 16 can be adjusted horizontally in the direction of the axial rolling device 11 and in the opposite direction thereto, as indicated by the double-headed arrow S1.

There is secured on the mandrel bearing head 16 a roller mandrel 15 which protrudes freely downwards in a vertical direction and which extends in an axial direction, that is to say, parallel with the vertical rotation axis of the ring preform R.

When the guiding carriage 20 is adjusted vertically along the path 22 of the column 21, the carriers 19, the mandrel bearing head 16 and the roller mandrel 15 are consequently at the same time also adjusted vertically, whereby the roller mandrel 15 can be introduced from above into the inner space of the ring preform R and guided through it. Accordingly, the roller mandrel 15, by raising the guiding carriage 20, can also be lifted out of the inner space of the ring preform R or the ring which is formed from it.

Below the table 13 there is provided in conventional manner a lower mandrel bearing 30 in which the roller mandrel 15 can be introduced with the lower end thereof so that it is then retained both at the lower end and at the upper end.

After the shaping of the ring preform R to form a ring of the desired size has finished, the axial rolling device is retracted again from the ring and the first linear displacement device 17 is displaced in such a manner that the mandrel bearing head 16 moves away from the guiding carriage 20 and consequently the spacing between the main roller 14 and the roller mandrel 15 is increased. At the same time or subsequently, the guiding carriage 20 is raised by activating the second linear displacement device 18 along the path 22 of the column 21, whereby the roller mandrel 15 is lifted out of the ring so that it is now free and can be removed by means of suitable lifting devices from the table 13.

The upper end of the roller mandrel 15 is secured in the mandrel bearing head 16 by means of a mandrel bearing element 31. In order to change the roller mandrel 15, the mandrel bearing element 31 can be removed in an upward direction from the mandrel bearing head 16. A new roller mandrel 15 can subsequently be introduced again from above into the mandrel bearing head 16 together with a new mandrel bearing element 31 and subsequently fixed to the mandrel bearing head 16. Alternatively, it is also possible to separate the mandrel bearing element 31 from the old roller mandrel 15 and to fit it to a new roller mandrel 15 and to then place the mandrel bearing element 31 together with the new roller mandrel 15 in the mandrel bearing head 16 or to change the roller mandrel 15 in the machine without removing the mandrel bearing element 31.

The roller mandrel 15 can be rotatably driven by means of a motor 32 in order to cool the roller mandrel 15 particularly during non-productive times of the radial/axial ring rolling mill.

The invention claimed is:

1. Radial/axial ring rolling mill for rolling a ring comprising an axial rolling device and a radial rolling device, wherein the radial rolling device has a main roller and a roller mandrel, between which the ring can be shaped, wherein the roller mandrel is retained in an upper region of the roller mandrel on a mandrel bearing head which is supported in a first linear adjustment device so as to be able to be horizontally adjusted in such a manner that the roller mandrel can be moved perpendicularly to a longitudinal extent of the roller mandrel in a direction towards the main roller and in an opposite direction away from the main roller, wherein the first linear adjustment device together with the mandrel bearing head and the roller mandrel can be translated vertically as a unit by a second linear adjustment device so that the roller mandrel can be pulled out of an inner space of the ring and introduced therein.

2. Radial/axial ring rolling mill according to claim 1, wherein the roller mandrel is retained in a non-displaceable manner in the mandrel bearing head.

3. Radial/axial ring rolling mill according to claim 2, wherein the roller mandrel is retained in the mandrel bearing head by clamping.

4. Radial/axial ring rolling mill according to claim 2, wherein the mandrel bearing head is fitted to at least one horizontal carrier.

5. Radial/axial ring rolling mill according to claim 2, wherein the roller mandrel is retained at the upper region on a mandrel bearing element which is releasably fixed in the mandrel bearing head.

6. Radial/axial ring rolling mill according to claim 2, wherein the roller mandrel can be rotated by a motor about a longitudinal axis of the roller mandrel.

7. Radial/axial ring rolling mill according to claim 1, wherein the roller mandrel is retained in the mandrel bearing head by clamping.

8. Radial/axial ring rolling mill according to claim 7, wherein the mandrel bearing head is fitted to at least one horizontal carrier.

9. Radial/axial ring rolling mill according to claim 7, wherein the roller mandrel is retained at the upper region on a mandrel bearing element which is releasably fixed in the mandrel bearing head.

10. Radial/axial ring rolling mill according to claim 7, wherein the roller mandrel can be rotated by a motor about a longitudinal axis of the roller mandrel.

11. Radial/axial ring rolling mill according to claim 1, wherein the mandrel bearing head is fitted to at least one horizontal carrier.

12. Radial/axial ring rolling mill according to claim 11, wherein the carrier engages in a displaceable manner through a guiding carriage of the first linear adjustment device.

13. Radial/axial ring rolling mill according to claim 12, wherein the guiding carriage of the first linear adjustment device can be adjusted along a vertically extending path of the second linear adjustment device.

14. Radial/axial ring rolling mill according to claim 13, wherein the guiding carriage of the first linear adjustment device can be fixed to the path of the second linear adjustment device.

15. Radial/axial ring rolling mill according to claim 14, wherein the first linear adjustment device is fixed to the path of the second linear adjustment device clamping.

16. Radial/axial ring rolling mill according claim 5, wherein the guiding carriage can be displaced vertically upwards to such an extent that the roller mandrel is moved completely out of the ring.

17. Radial/axial ring rolling mill according to claim 1, wherein the roller mandrel is retained at the upper region on a mandrel bearing element which is releasably fixed in the mandrel bearing head.

18. Radial/axial ring rolling mill according to claim 10, wherein the mandrel bearing element fixed in the mandrel bearing head by clamping.

19. Radial/axial ring rolling mill according to claim 1, wherein the roller mandrel can be rotated by means of a motor about a longitudinal axis of the roller mandrel.

* * * * *